US005494288A

United States Patent [19]

Jimenez et al.

[11] Patent Number: 5,494,288

[45] Date of Patent: Feb. 27, 1996

[54] TAIL-HEAVY PUTTER

[76] Inventors: Rafael F. Jimenez, 312 Spring St., Richland, Wash. 99352; Gregory L. Jimenez, 3301 71st Ave. Ct. W. #8-201, Tacoma, Wash. 98466

[21] Appl. No.: 292,229

[22] Filed: Aug. 22, 1994

Related U.S. Application Data

[63] Continuation of Ser. No. 987,072, Dec. 7, 1992, abandoned, which is a continuation of Ser. No. 704,726, May 20, 1991, abandoned, which is a continuation of Ser. No. 447,051, Dec. 7, 1989, abandoned.

[51] Int. Cl.[6] ..... A63B 53/04

[52] U.S. Cl. ..... 273/164.1; 273/80 C; 273/167 G; 273/169; 273/81 A; 273/167 H

[58] Field of Search ..... 273/81 R, 81 A, 273/80 R, 80 A, 80 B, 80 C, 167 R–77 A, 193 R, 194 R, 194 A, 194 B, 164.1, 186.1, 186.2, 187.4

[56] References Cited

U.S. PATENT DOCUMENTS

| | | | |
|---|---|---|---|
| 1,518,316 | 12/1924 | Ellingham | 273/171 |
| 1,983,196 | 12/1934 | Spiker | 273/171 X |
| 3,191,936 | 6/1965 | Guier | 273/80.2 |
| 3,399,898 | 9/1968 | Burkland | 273/167 F |
| 3,679,207 | 7/1972 | Florian | 273/81 A X |
| 3,979,122 | 9/1976 | Belmont | 273/171 |
| 4,203,598 | 5/1980 | Stuff et al. | 273/81 A X |
| 4,240,636 | 12/1980 | Swenson | 273/169 |
| 4,325,553 | 4/1982 | Taylor | 273/171 X |
| 4,361,329 | 11/1982 | Brock | 273/162 E |
| 4,415,156 | 11/1983 | Jorgensen | 273/81 A X |
| 4,423,874 | 1/1984 | Stuff | 273/171 |
| 4,444,395 | 4/1984 | Reiss | 273/171 |
| 4,461,479 | 7/1984 | Mitchell | 273/81 A |
| 4,690,407 | 9/1987 | Reisner | 273/81 A |
| 4,693,478 | 9/1987 | Long | 273/164 |
| 4,695,054 | 9/1987 | Tunstall | 273/171 |
| 4,828,266 | 5/1989 | Tunstall | 273/171 |
| 4,852,879 | 8/1989 | Collins | 273/169 |
| 4,887,815 | 12/1989 | Hughes et al. | 273/81 A X |
| 4,913,438 | 4/1990 | Anderson | 273/164 |
| 4,927,144 | 5/1990 | Stormon | 273/171 X |
| 4,962,932 | 10/1990 | Anderson | 273/171 |
| 5,004,237 | 4/1991 | Antonious | 273/169 X |

FOREIGN PATENT DOCUMENTS

| | | | |
|---|---|---|---|
| 646942 | 8/1962 | Canada | 273/171 |
| 7279 | of 1902 | United Kingdom | 273/171 |

OTHER PUBLICATIONS

"Golf Digest" Magazine, Aug. 1967 issue, p. 72.
"Golf Digest" Magazine, Oct. 1961 issue, p. 66.

*Primary Examiner*—Sebastiano Passaniti
*Attorney, Agent, or Firm*—Floyd E. Ivey

[57] ABSTRACT

A golf putter is disclosed having a face that tends to stay square to the swing path as a result of an increased static moment about the putter shaft. The increased static moment is a result of the tail section of the putter head having a mass greater than the toe section. The putter shaft includes a forwardly offset portion spaced above the putter head to enable a golfer to observe a golf ball and the putter face at address.

11 Claims, 10 Drawing Sheets

TAIL-HEAVY PUTTER

This is a continuation of application Ser. No. 07/987,072 filed Dec. 7, 1992 which is a continuation of Ser. No. 07/704,726, filed May 20, 1991, which is a continuation of Ser. No. 07/447,051, filed Dec. 7, 1989 now abandoned.

SUMMARY OF THE INVENTION

When putting a golf ball with a conventional putter (including even a putter which is statically "face-balanced," that is, a putter which when balanced about the horizontal shaft, the putter face remains horizontal), the putter face will open upon positive acceleration (dv/dt>0) arid close upon deceleration (dv/dt<0). We have come up with two versions of our tail heavy putter: the "0–0 EDGE" which is slightly tail heavy and is dynamically balanced while being swung and is force balanced when striking a golf ball; and the "Heel-Heavy" which tends to open when decelerating and when a golf ball is struck. The "Heel-Heavy" is for those players who tend to close the putter face when swinging or striking the ball.

Additionally, the sole has a surface described by a two-coordinate relationship (i.e., it is not a planar surface) which virtually eliminates the bad effects resulting from catching the putter tail or toe on the putting surface or from scuffing the sole on the green.

The putter is vertically counter-balanced by inserting weights onto or into the top end of the shaft—making it easier to swing the putter. Weighting the top of the shaft is the most efficient method of counterweighting as it requires the least amount of weight. This technique is applicable to both golf putters and golf clubs. The putter is constructed with the hosel attached to the backside of the putter blade—so that even with the shaft and hosel constructed in-line, and the "sweet spot" also in line, the golfer is still able to easily see the back of the golf ball when lining up the putt.

The transmittal of force from the putter shaft to the ball is direct (i.e., no "moment" members are involved) because the shaft, hosel, and ball center are all in line. Thus, it is relatively easy to hit the ball the correct distance.

DRAWINGS

Sheets 1–10, FIGS. 1 through 15 (enclosed).

DESCRIPTION OF THE SEVERAL DRAWINGS OF THE "TAIL-HEAVY PUTTER"

The following drawings illustrate the scientific basis for and/or the design of the "Tail-Heavy Putter":

| Figure # | Figure Description |
|---|---|
| 1 | This illustrates the translational and rotational movement of the golf club just before the ball is struck. The instantaneous center of club rotation is also shown. |
| 2 | This illustrates how vertical counter-balancing of a golf club can most efficiently be done by placing a counterweight at the top of and just inside the shaft. A patent is sought on this method of counter balancing. |
| 3 | This figure illustrates how the putter "marker" position (i.e., the so-called "sweet-spot" location) is determined. First, the "expected horizontal plane of contact" between the ball and putter face is determined. Then the "Marker" position is placed at the intersection of this horizontal plane and a plane running through the putter shaft as shown on the drawing. |
| 4 | This shows a cross-section of the putter head and illustrates the shape of the putter sole. The sole shape at the front and back is either a conic surface or a portion of the surface of a hyperboloid of revolution. The central portion is semi-flat but the entire sole is rounded from tail to toe with a maximum radius of 10". Thus no part of the sole surface is a planar surface but instead, the surface is a function of two coordinates (the front to back coordinate and the heel-to-toe coordinate). |
| 5 | This illustrates that the toe is approximately 1" further from the putter swing axis than is the tail. Thus when the putter is swung (i.e., rotated about the swing axis) the toe has a greater velocity than the tail. Therefore if the putter face is to stay square, without any additional external rotating force, the tail static moment about the shaft must be greater than the toe static moment (hence the designation "tail-heavy"). |
| 6 | This figure defines the main putter design feature for which a patent is being applied for. The patent is to cover a putter which must have an added force moment (AFM) on the toe side in order to statically balance the putter head about the shaft. This safely keeps this putter out of the design range of those which have here-to-fore been manufactured. A very few putters are statically balanced and none (except when miscast) are designed to be tail heavy except the "AS BACKWARDS" which has the shaft coming into the toe and thus is extremely tail heavy. The vast majority (Ping, Bullseye, etc.) are quite toe heavy. We are seeking a patent for a putter which is between 0.1% tail heavy and 15% tail heavy (percentage tail heavy is defined on this drawing). |
| 7 | This figure is an isometric sketch of the gulf putter head. |
| 8 | Plan View of the Tail Heavy Putter Head. |
| 9 | Rear view of the Tail Heavy Putter Head. |
| 10 | Front view of the Tail Heavy Putter Head. |
| 11 | Toe side elevation - Tail Heavy Putter Head |
| 12 | Tail side elevation - Tail Heavy Putter Head. |
| 13 | Illustrates how the golfer can easily see the back of the ball while lining up a putt because the hosel is attached to the back of the putter blade. |
| 14 | Illustrates how lining up a putt is easier with the Tail-Heavy Putter, because the marker, ball center, and intended ball path are easy to line up. |
| 15 | This figure illustrates how the force transfer from the shaft to the ball contact point is direct because the shaft, hosel, and contact point are in line. |

DETAILED DESCRIPTION OF PATENT

Figure 1:
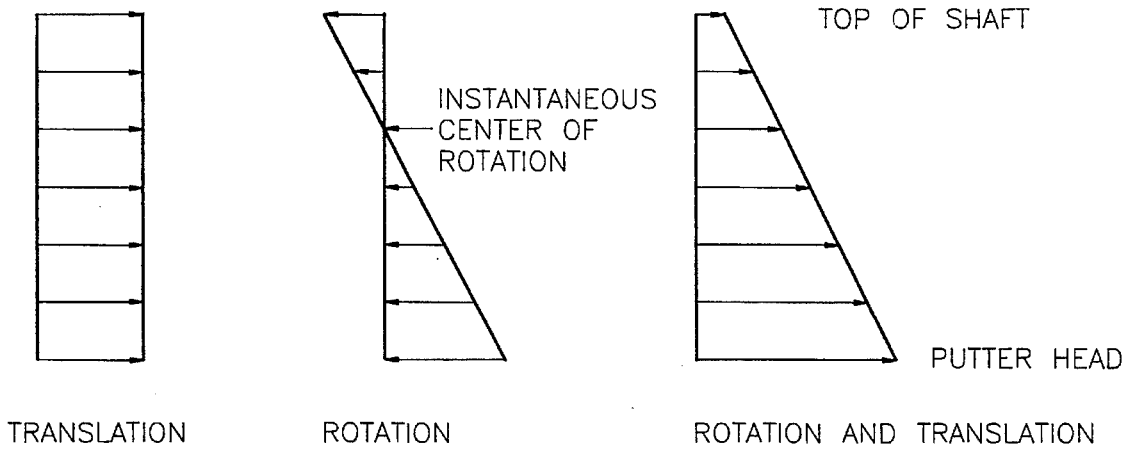

I. The main golf putter improvements we have made (i.e., dynamic swing balance and the elimination of putter face twist when the ball is struck (only strictly true for our "0–0 EDGE" putter) stem from the concept, shown in FIG. 1, that just before the ball is struck the movement of the club can be described by a translational movement and a rotational movement of the putter. Thus the putter must be statically, "tail-heavy" to be in dynamic balance.

Figure 2:
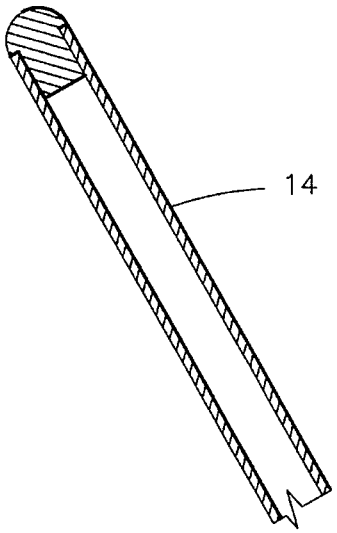

II. Another important improvement is the counter weighting of the putter (or any golf club) by adding weight at the top of the shaft as shown in FIG. 2. A patent on the concept of counter weighting is not sought but rather the:

a. Method of counterweighting as shown in FIG. 2.

b. Degree of counterweighting, that is counterweighting in the extreme, by adding approximately 0.3–1.5 oz. to the top of the shaft to facilitate the rotation of the club as it is swung at the golf ball.

Figure 13:
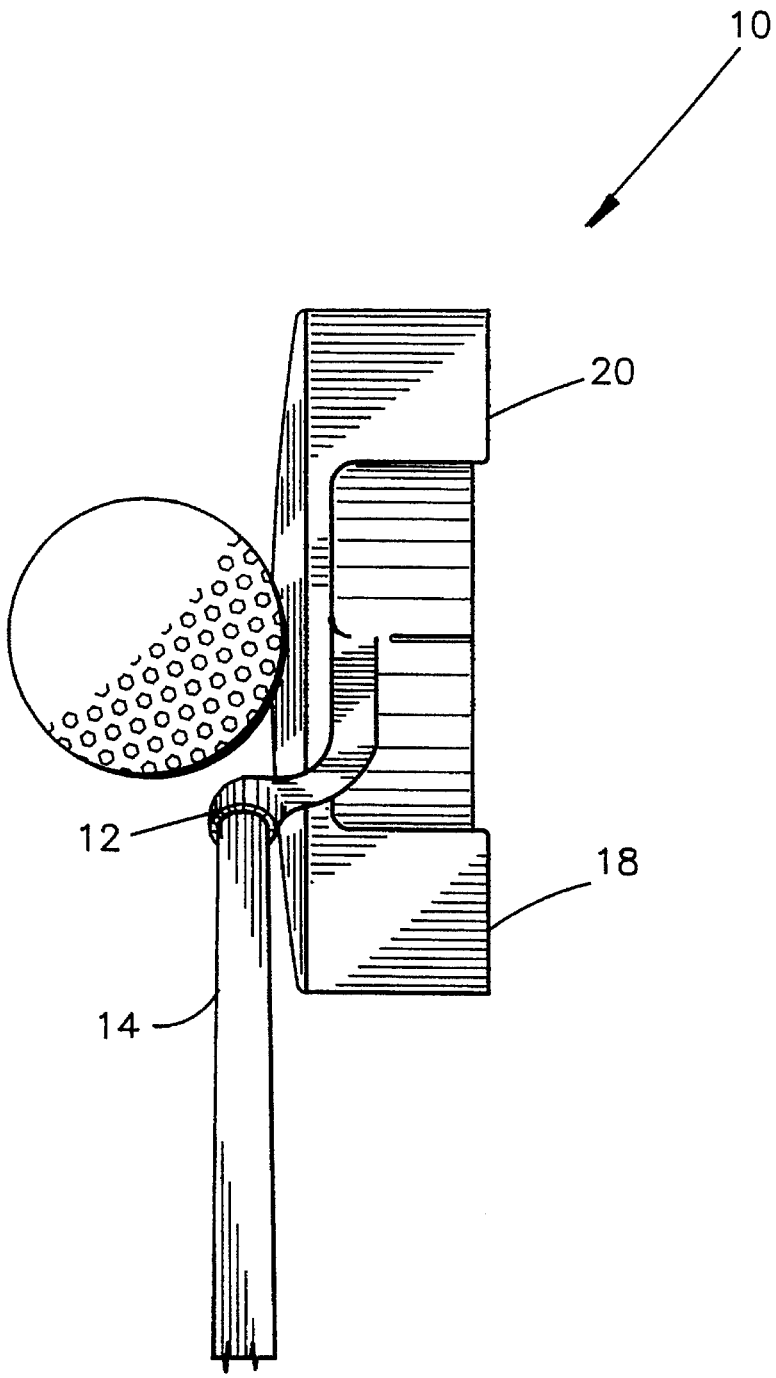
Figure 14:
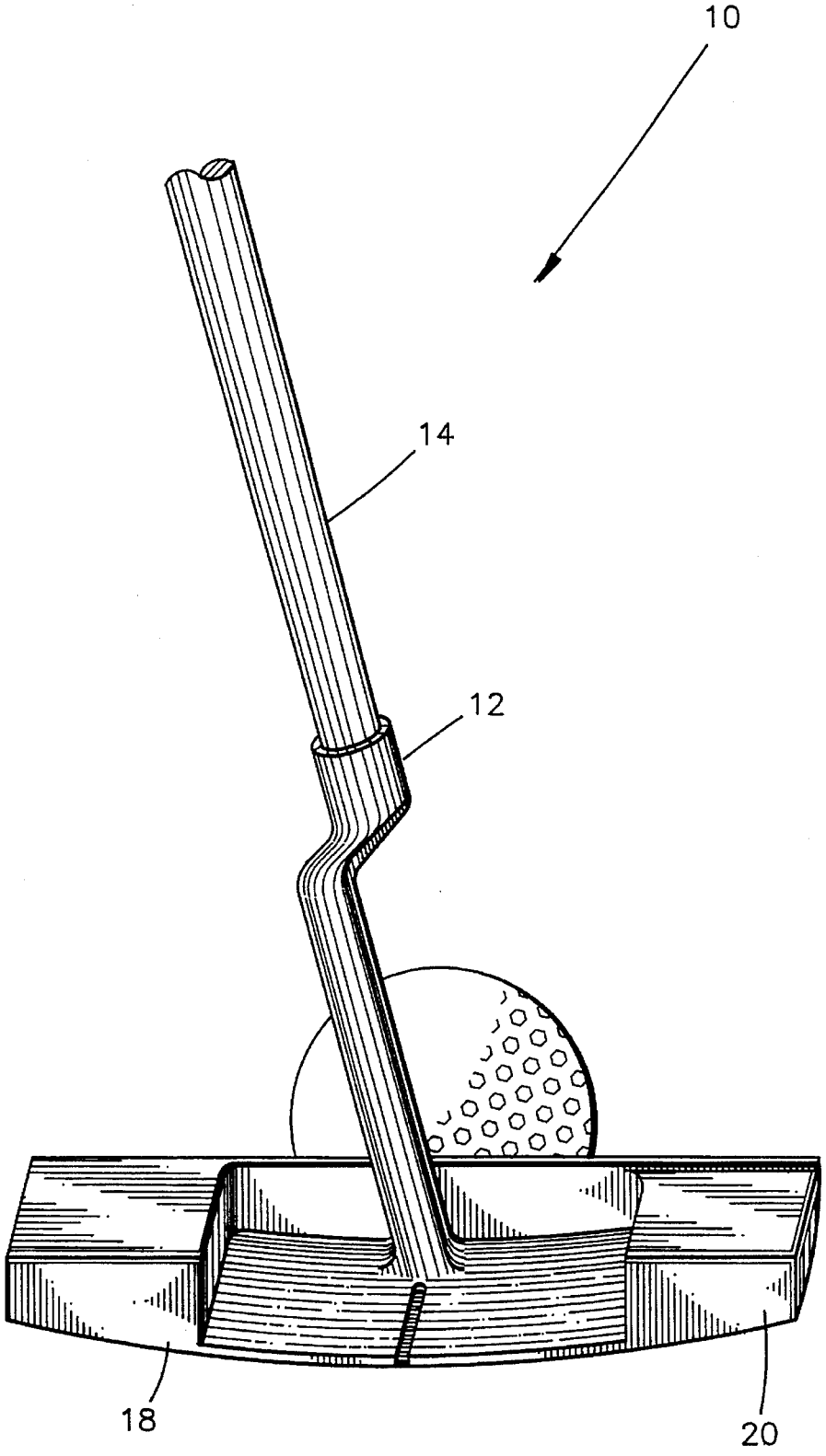
Figure 15:
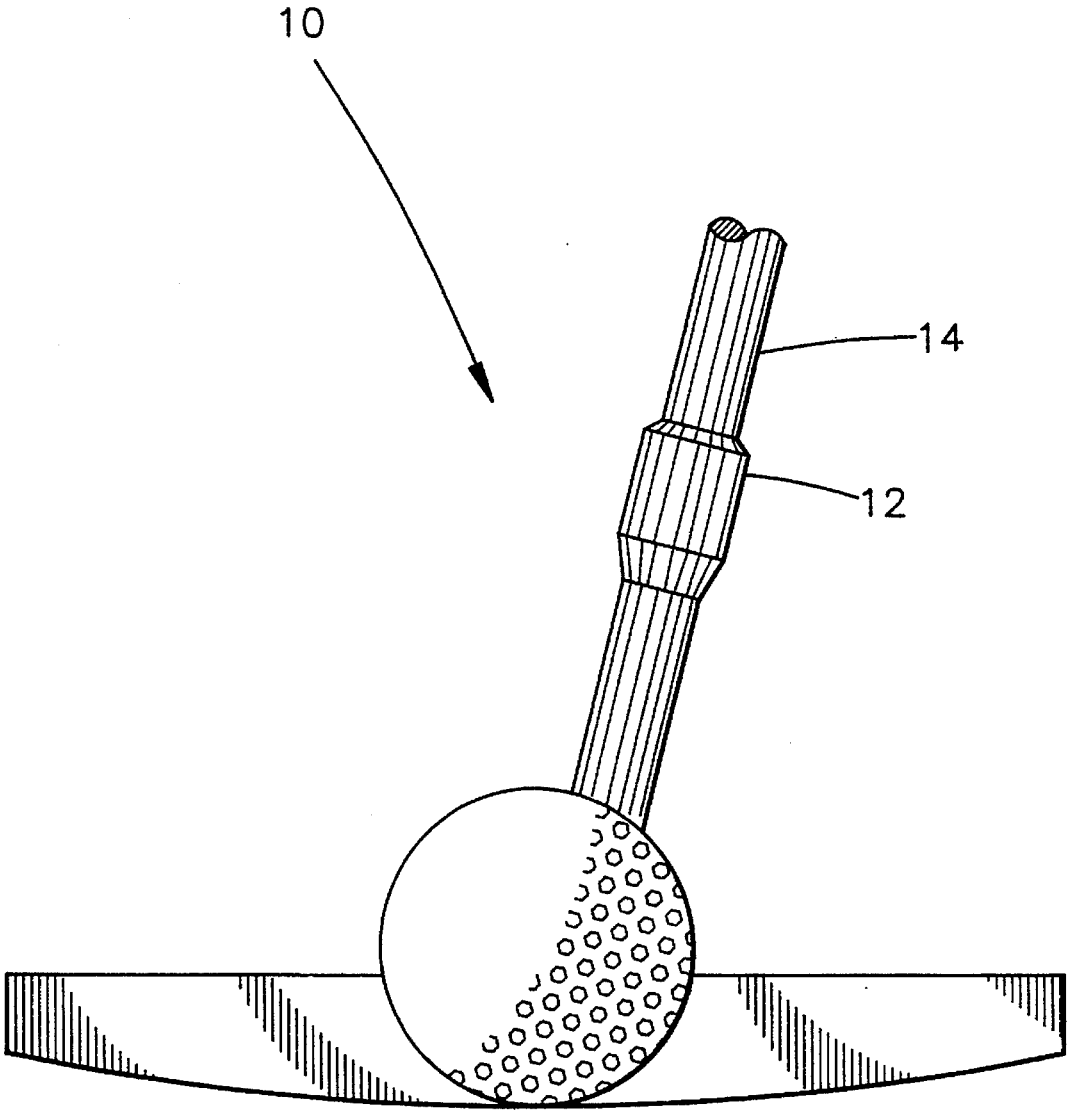

III. A third improvement is that the attitude of the putter blade, hosel, shaft, and putter marker is such that:

a. The back of the ball can be easily seen when preparing to putt (FIG. 13).

b. Lining up the putt is easier than with other putters because lining up the marker, the ball centerline, and the intended ball path is facilitated (FIG. 14).

c. Force transfer from the shaft to the ball is more direct (i.e., moment carrying members are not used in the plane perpendicular to the ball path) than with other putters because the shaft center-line, the hosel centerline, and the ball contact point are in line (FIG. 15).

IV. Another major improvement is that the bottom surface of the putter head (i.e., the "sole") is conic-shaped (see FIG. 4: cone-shaped sole surface) to decrease the possibility of and the deleterious effects of scuffing the putter sole on the green (note that this bottom surface is not a planar surface but is a true two-dimensional surface defined by the tail-to-toe coordinates and by the coordinates in the direction perpendicular to the tail-toe direction).

The conic-shaped sole decreases the possibility of scuffing the club by:

a. Rounding the putter head in the tail to toe direction (a 10" maximum radius is used).

b. Beveling or rounding the sole in the direction perpendicular to the tail-toe direction to prevent scuffing the frontal portion of the putter head on the forward swing or the back portion of the putter head on the back swing.

These four major improvements are the basis for this patent application. Our "0–0 EDGE" putter is now in production on a small scale (290 putters, including 22 light-weight prototypes, have been produced since April 1989). The prototype was introduced at an industrial trade show in Pasco, Wash., on May 5–6, 1989. The production of full-weight putters began in June 1989 and the putter was shown at the Pacific Northwest Professional Golfer Association exhibit on Oct. 29–30 in Tacoma, Wash. The putter has been extremely well received. Production has not proceeded at a fast pace because both my son and I are employed full time and because, up to this time, we have not sought outside financial assistance in our venture since we have chosen not to dilute our ownership. The proof of the viability of these golf putter improvements is that the putter we are manufacturing has performed extremely well. Approximately one-half of the golfers who have bought our new putter formerly used the "PING" putter which has had the reputation of being one of the best putters available. (The "PING" putter was used to win the four most prestigious golf tournaments in 1988: The Masters, the PGA, and the American and British Opens.)

We do not pretend that our putter is as prestigious or well known as other putters, but we do contend that our putter is better than any other putter for most golfers.

A detailed description of how these four major golf putter improvements are obtained follows below.

V. Detailed Description of How the Four Major Improvements Are Obtained.

The following design improvements and concepts are used in our "0–0 EDGE" putter and explained in detail below:

a. Translational and Rotational Movement of the Golf Putter (or golf club).

Just before a golf putter (or golf club) strikes the ball, it is undergoing both translational and rotational motion in the plane parallel to the direction in which the ball will travel. Though the top of the club is hinged at the left wrist (for a right-handed player), in actuality the instantaneous center of rotation is between the top of the putter shaft and the putter head. Superimposed upon this rotation is the translational motion of the entire putter in the direction of the ball travel. This is illustrated in the velocity diagrams shown in FIG. 1.

b. Dynamic Balancing About the Shaft. Incorporating into the design of the "0–0 EDGE" putter is dynamic balancing about the shaft as the putter is swung backward and forward. Dynamic balancing keeps acceleration forces from twisting the putter head about the shaft as it is swung back and forth. The concept of making the putter tail heavy arises from theories of dynamics and mechanisms that state that mass further from the swing center (FIG. 5) has greater velocity and acceleration and therefore exerts a greater acceleration force. Thus the putter is slightly tail heavy when statically balanced as the toe velocity is greater than that of the tail because it is further from the instantaneous swing center. The concept of zero dynamic twist represents the first "0" in "0–0 EDGE." This feature stems from the rotational concept shown in FIG. 1.

c. Marking the Golf Putter "Sweet Spot" so that No Twist is Imparted to the Putter When the Ball is Struck. The "0–0 EDGE+ putter has its "sweet spot" marked so that if the ball is struck correctly, there is no twist imparted to the putter blade provided that:

The marker and ball are in line at the moment of contact.

Figure 3:
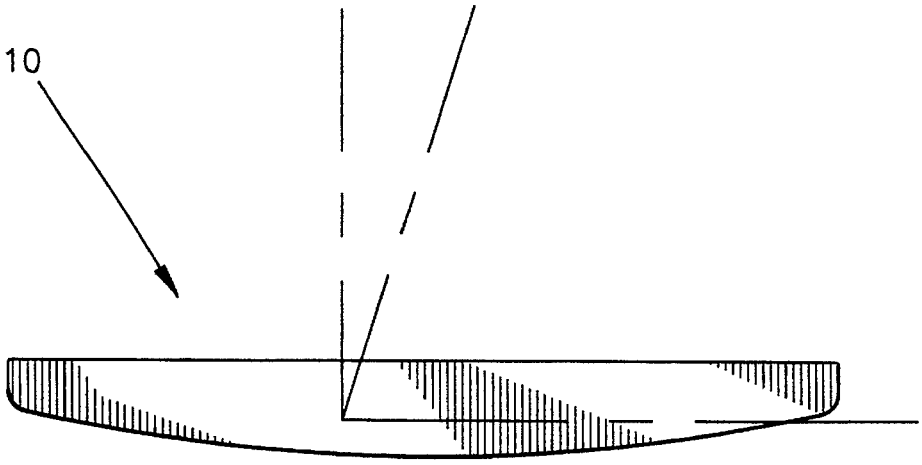

The ball-putter face contact point is in line with the shaft center line (note: there is no single vertical plane parallel to the ball path that intersects the shaft centerline extension but rather an infinite number of vertical planes parallel to the ball path which intersect the extension of the shaft centerline). The position of the plane (and the marker) is defined by how high on the putter face the putter face-ball contact occurs. The position of the "sweet spot" marked on the putter is based upon-the spot (vertically) on the putter face where the ball-putter face contact is most likely to be made-being in line with the extension of the shaft centerline, as shown in FIG. 3.

No inordinate amount of twist is imparted to the putter shaft by the golfer's hands.

This design feature represents the second "0" in "0–0 EDGE."

d. Vertical Counterbalancing of the Golf Putter (or golf club). Most golfers prefer a putter which has a certain feel when swung (that is the putter head feels neither too heavy nor too light). There can be a substantial difference in the weight of different putter heads, shafts, and grips. If shafts or grips are used which have sub-standard weights, the swing feel can be restored by counter-balancing the shaft. This can easily be done by inserting weights into the top of the shaft. This is the most efficient way of counterbalancing the putter as the least amount of weight is added. This method of counter balancing stems from the concept of rotational motion of the club is discussed in paragraph a (above). FIG. 2 illustrates how weights are inserted at, and into, the top of the shaft.

e. Shaft and Hosel In-Line The "0–0 EDGE" putter has the shaft and hosel directly in line when viewed from behind the ball. The hosel is attached to the back of the putter blade. Therefore:

Because the hosel is attached to the back of the putter blade, which is about one-quarter inch thick, the golfer can see the back of the ball even though the hosel and shaft are in line (see FIG. 13).

Lining up the putt is easier than with other putters because the golfer tends to putt with his eyes in-line with the intended ball path and the putter marker (i.e., he feels like his eyes are in line with the ball path and the ball as they should be to prevent pulling or pushing). See FIG. 14.

The force transfer from the shaft—to the putter face—to the ball has a direct path (i.e., the force is not transmitted through "moment" carrying member(s)). Most putters employ an indirect path for this force as the putter shaft, the hosel, and the "sweet-spot" marker are not in line. (See FIG. 15.) This feature makes it easier to hit the ball the intended distance.

f. Conic-Shaped Sole. A conic-shaped sole is used to prevent scuffing of:

The putter head tail or toe. This is accomplished by rounding from tail to toe with a maximum radius of 10".

The putter head sole-frontal portion. This is accomplished by rounding or beveling the frontal portion of the sole. This prevents scuffing on the forward swing.

The putter head sole-rear portion. This is accomplished by rounding or beveling the rear portion of the sole. This prevents scuffing on the back swing.

Figure 4:
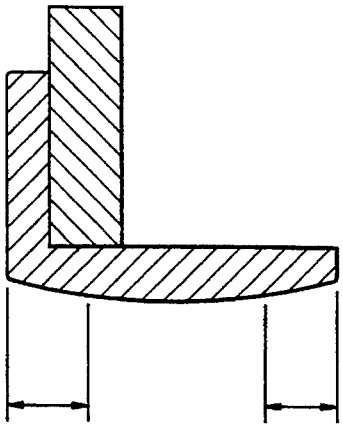

Combining these three features result in the putter having a conic-shaped sole (i.e., the sole surface is not a plane but is a two-dimensional surface shaped like the surface of a circular cone) at the front and back if beveling is used or an oval-shaped sole (i.e., the sole surface is a portion of the surface of a hyperboloid of revolution) if rounding is use. This design feature represents the "EDGE" in "0–0 EDGE" as shown in FIG. 4 (attached).

g. The "Heel-Heavy" model of our putter will be similar to the "0–0 EDGE" except the putter blade will not be in dynamic balance as the putter is swung back and forth. Instead, the putter tail will be heavier than is needed for dynamic balance (approximately 10% tail heavy as defined in FIG. 6). This putter is designed for those golfers who rotate the putter shaft counter-clockwise as they swing the putter towards the ball. Since most golfers actually decelerate the putter as it approaches the ball, the face of this putter tends to open as the putter face approaches the ball. This shaft rotational moment counteracts the counter clockwise rotation movement being applied to the putter by the golfer-and thus the face tends to stay square. The putter marker is in line with the putter shaft centerline and the ball centerline so that there is no force moment between the ball and the shaft when the ball is contacted. A net clockwise rotational moment is applied to the shaft at the moment of impact because the tail force-moment is greater than the toe force-moment. This clockwise rotational moment is balanced by the counter clockwise moment being applied by the golfer.

Figure 5:
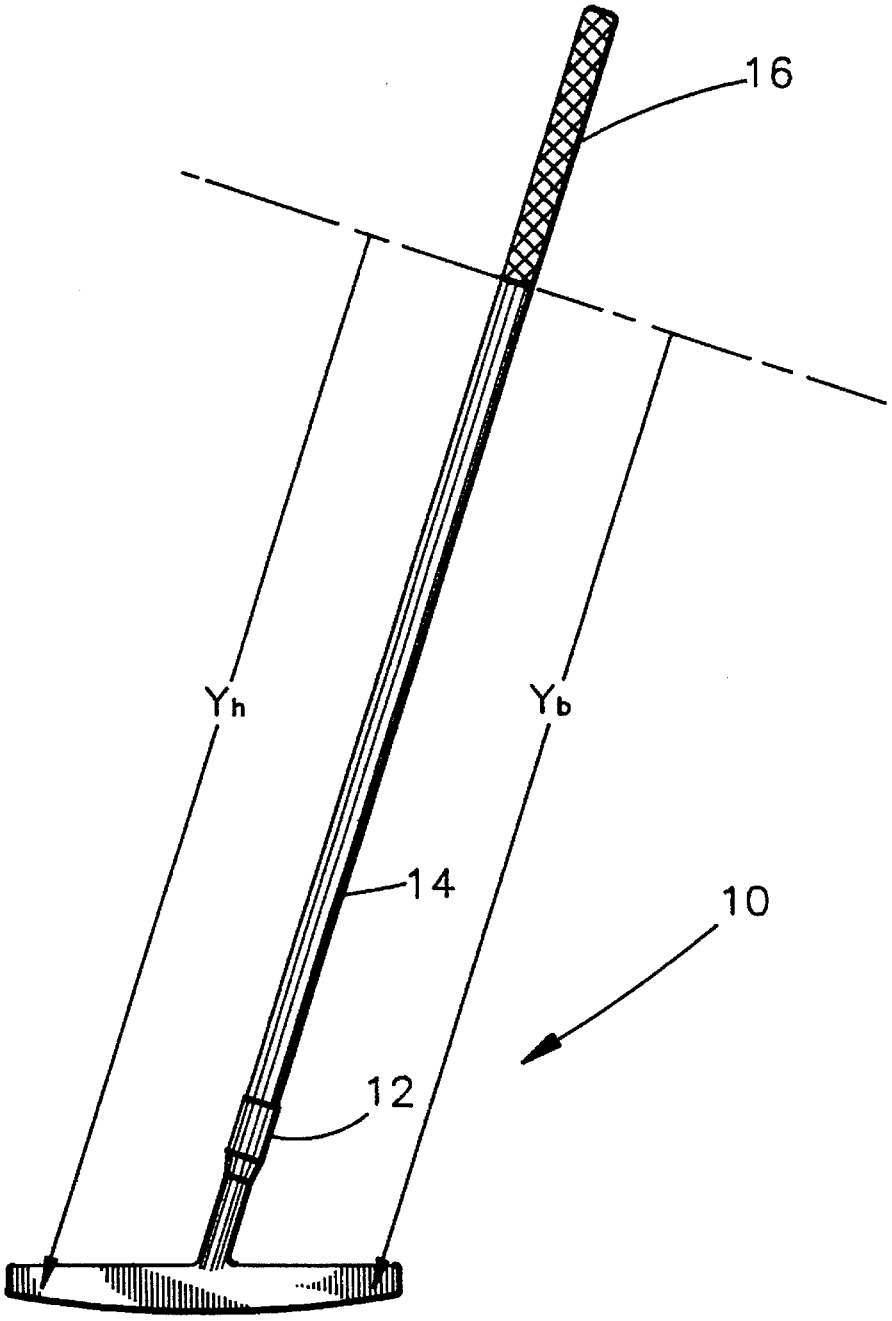
Figure 6:
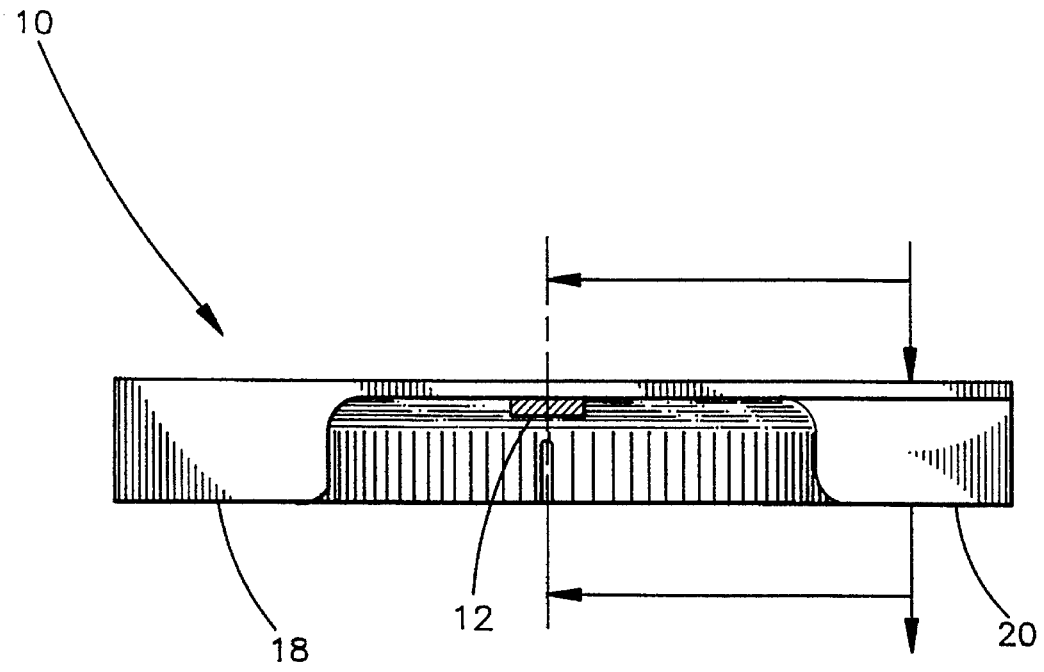
Figure 7:
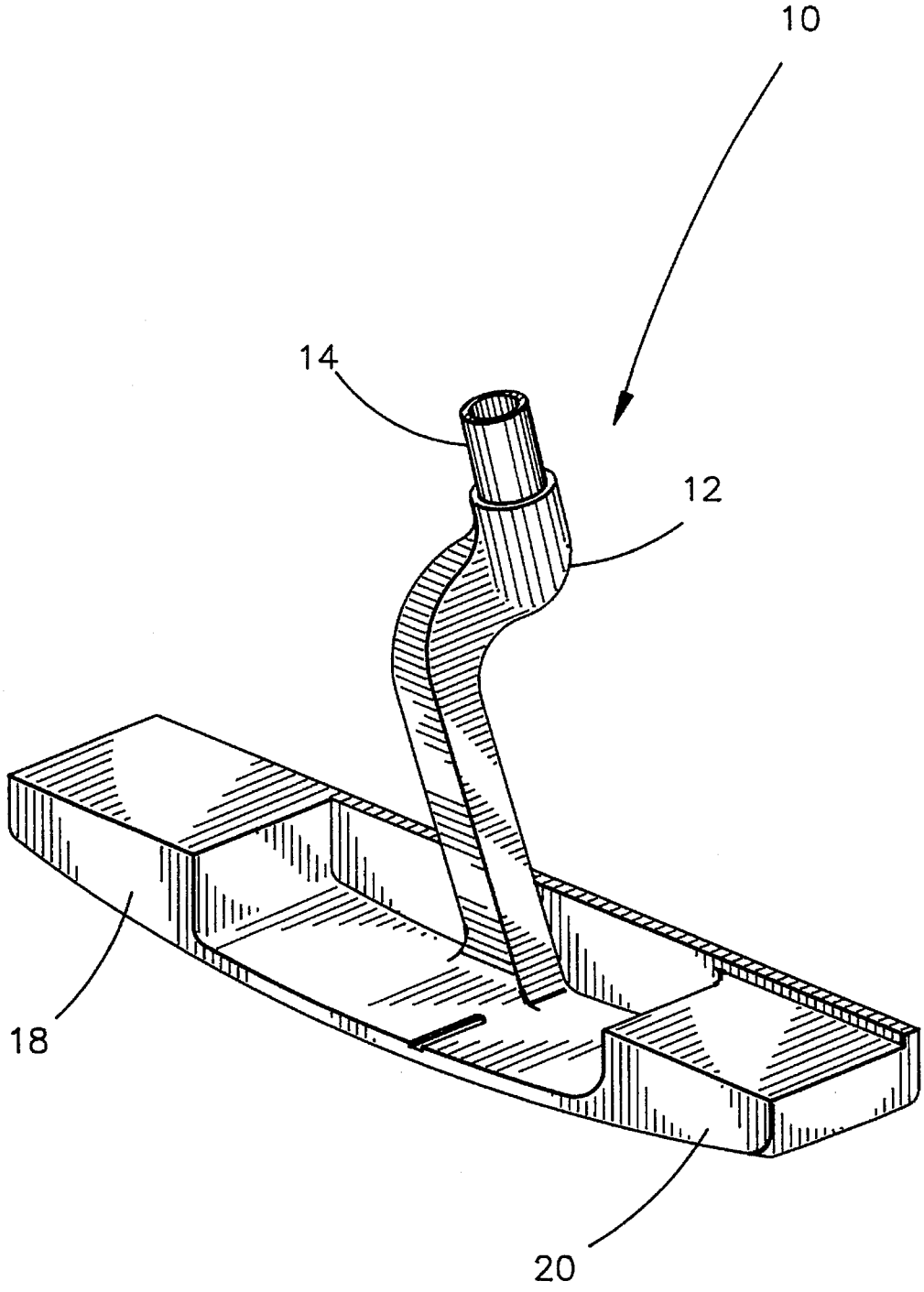
Figure 8:
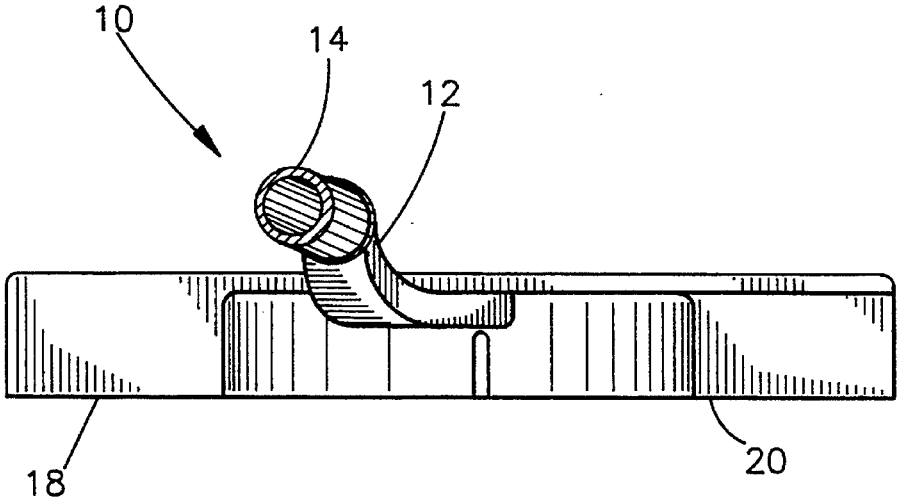
Figure 9:
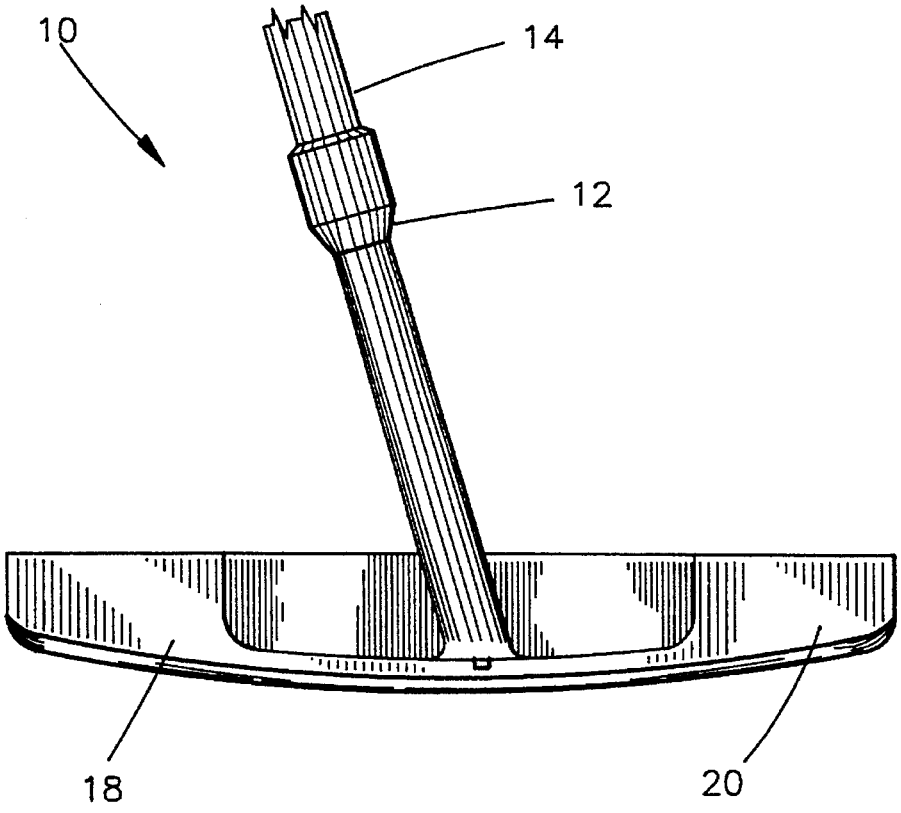
Figure 10:
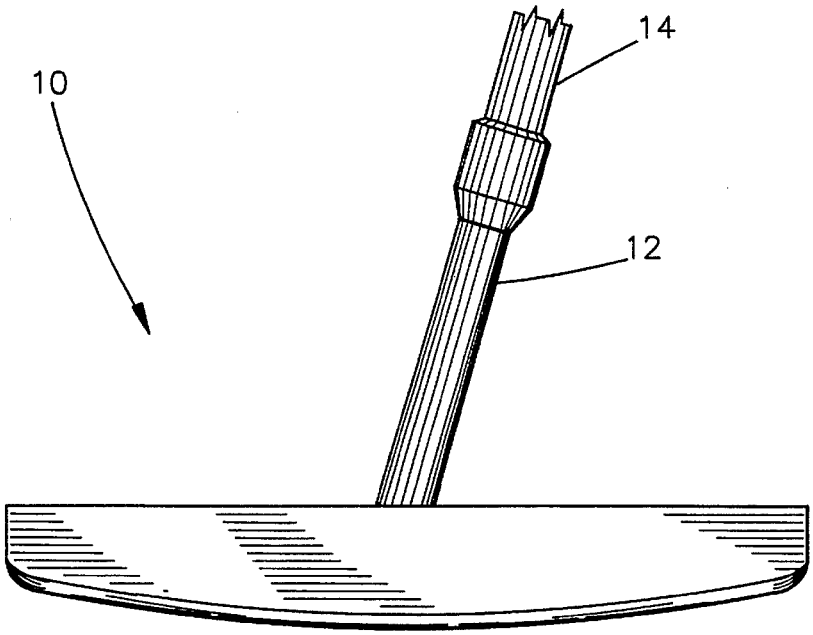
Figure 11:
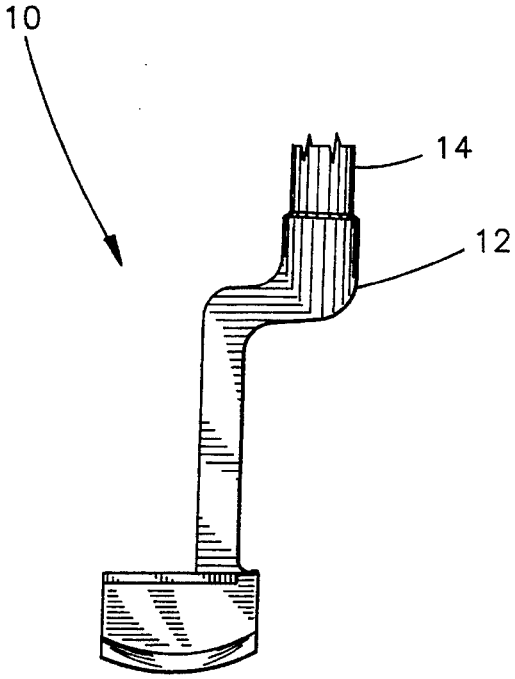
Figure 12:
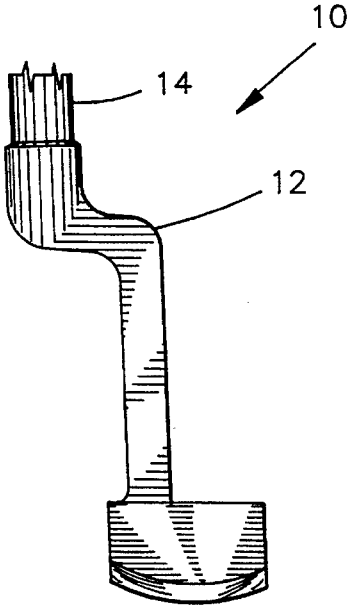

Referring to FIGS. 5 and 6, applicants have shown an improved putter head 10 constructed according to the present invention which is operatively attached to a hosel 12. Hosel 12 is attached to an elongate shaft 14 with a grip 16 fitted over one of its ends.

Referring to FIG. 6, head 10 includes a tail section 18 and a toe section 20. Tail section 18 has a force moment associated therewith that is 0.1% to 15% greater than the force moment associated with toe section 20. Those skilled in the art know that force moment=mass X distance from the centerline of an axis. Thus, for example, to calculate the force moment of tail section 18, one multiplies the weight of section 18 by its distance from the axis defined by shaft 14.

PATENT CLAIMS

The following claims are made for the "0–0 EDGE" tail-heavy putter now being produced by Pacific Golf of Richland, Wash.:

1. A golf putter comprising an elongate shaft including a longitudinal center line defining a shaft axis, a putter head rigidly connected to one end of a shaft axis, hand grip means at the other end of the shaft, said putter head including a flat putter face, a toe section and a tail section spaced from said shaft axis, said shaft being upwardly inclined toward the tail section to define an instantaneous swing axis perpendicular to the longitudinal shaft axis thereby spacing the swing axis a greater distance from the toe section than the distance between the swing axis and the tail section for moving the toe section at a velocity greater than the tail section during translational and rotational motion of the putter as it strikes a golf balls and wherein;

said golf putter head includes a recess extending from a rear surface of the putter head toward said putter face, said recess being defined by a front wall generally parallel and spaced from the putter face, a pair of spaced end walls, a bottom wall and an open rear area, said shaft having a lower end rigidly connected to said front wall of the recess and said bottom wall of the recess, said lower end of said shaft extending above the putter head and including a forwardly offset portion spaced above the putter head, said forwardly offset portion terminating in an elongated upper portion of the shaft oriented forwardly of the putter face to enable a golfer to observe the relation between the putter face and rear portion of a golf ball as the putter face approaches and strikes the golf ball.

2. The golf putter as defined in claim 1 wherein the static force moment of the tail section is approximately 0.1% to 15% greater than the static force moment of the toe section relative to the shaft axis.

3. The golf putter as defined in claim 1 wherein said shaft is connected to said putter head substantially at the center of the putter head between toe and tail.

4. The golf putter as defined in claim 1 wherein said greater static force moment of the tail section results from the tail section having a mass greater than the toe section.

5. The golf putter as defined in claim 1 wherein said greater static force moment of the tail section results from the tail section having a mass times its moment arm greater than the mass times its moment arm of the toe section.

6. A golf putter as defined in claim 1 wherein said putter head is of unitary one piece construction.

7. The golf putter as defined in claim 1 wherein said golf putter head includes a bottom surface defining a sole extending smoothly between toe and tail ends of the golf putter head, said sole being curved longitudinally and transversely.

8. The golf putter as defined in claim 1 wherein the static force moment of the tail section is approximately 0.1% to 15% greater than the static force moment of the toe section relative to the shaft axis, said shaft axis being located substantially equally spaced from said toe section and tail section.

9. A golf putter comprising an elongate shaft including a longitudinal center line defining a shaft axis, a putter head rigidly connected to one end of a shaft axis, hand grip means at the other end of the shaft, said putter head including a flat putter face, a toe section and a tail section spaced from said shaft axis, said shaft being upwardly inclined toward the tail section to define an instantaneous swing axis perpendicular to the longitudinal shaft axis thereby spacing the swing axis a greater distance from the toe section than the distance between the swing axis and the tail section for moving the toe section at a velocity greater than the tail section during translational and rotational motion of the putter as it strikes a golf ball, and wherein;

said golf putter head includes a recess extending from a rear surface of the putter head toward said putter face, said recess being defined by a front wall generally parallel to and spaced from the putter face, a pair of spaced end walls, a bottom wall and an open rear area, said shaft having a lower end rigidly connected to said front wall of the recess or said bottom wall of the recess or both walls of the recess.

10. The golf putter as defined in claim 9 wherein said golf putter head includes a bottom surface defining a sole extending smoothly between toe and tail ends of the golf putter head, said sole being curved longitudinally and transversely.

11. The golf putter as defined in claim 9 wherein the static force moment of the tail section is approximately 0.1% to 15% greater than the static force moment of the toe section relative to the shaft axis, said shaft axis being located substantially equally spaced from said toe section and tail section.

* * * * *